United States Patent [19]

Finch, Jr.

[11] 4,177,792

[45] Dec. 11, 1979

[54] DRILLING RIG HEATER

[76] Inventor: Clyde E. Finch, Jr., 601 Glendale, Alice, Tex. 78332

[21] Appl. No.: 890,619

[22] Filed: Mar. 20, 1978

[51] Int. Cl.[2] ..... F24C 5/00; F23D 5/02

[52] U.S. Cl. ..... 126/93; 126/94; 431/341

[58] Field of Search ..... 126/93, 94, 84; 431/341

[56] References Cited

U.S. PATENT DOCUMENTS

| | | | |
|---|---|---|---|
| 1,927,434 | 9/1933 | Cole et al. | 126/93 |
| 2,137,469 | 11/1938 | Willson | 126/93 |
| 2,240,283 | 4/1941 | Breese | 126/93 |
| 2,396,675 | 3/1946 | Breese | 126/93 |
| 2,396,820 | 3/1946 | Breese | 126/93 |
| 2,486,481 | 11/1949 | Kissam | 126/93 |
| 2,506,841 | 5/1950 | Robinette | 126/93 |
| 2,570,049 | 10/1951 | Densel | 126/94 |
| 2,595,448 | 5/1952 | Breese | 126/94 |
| 2,610,621 | 9/1952 | Ingram | 126/94 |
| 3,029,803 | 4/1962 | Breese | 126/94 |

*Primary Examiner*—Samuel Scott
*Assistant Examiner*—Daniel J. O'Connor
*Attorney, Agent, or Firm*—Jack W. Hayden

[57] ABSTRACT

A heater includes a first housing which forms a fuel reservoir and a base support to maintain the heater in an upright position. A first elongated hollow or tubular member is secured to the top of the first housing with its lower end communicating with the interior of said first housing and extends upwardly therefrom. A second housing is mounted on top of the first housing and is provided with opening or port means to communicate the top of the first housing with the second housing. Port means in the second housing also communicates the second housing with the first elongated tubular member. A second elongated, hollow or tubular member is mounted on the second housing and extends upwardly therefrom. Its lower end communicates with the top of the second housing for communicating air to the second housing. Valve means are provided in each the first and second elongated hollow members for selectively controlling communication therethrough.

7 Claims, 5 Drawing Figures fig. 2
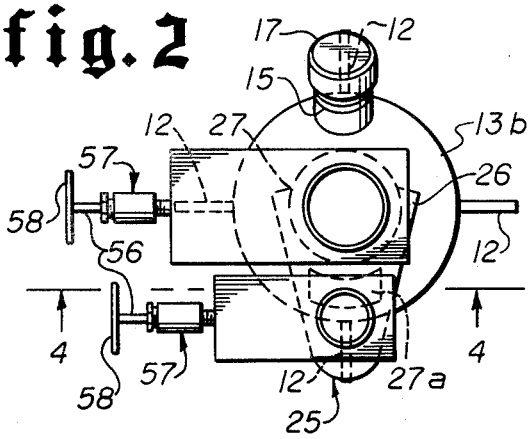
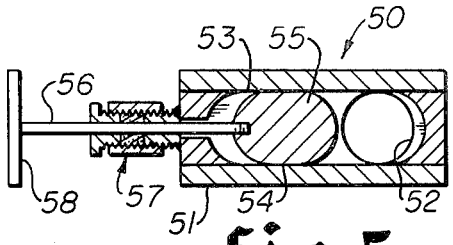
fig. 5
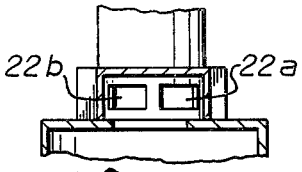
fig. 4
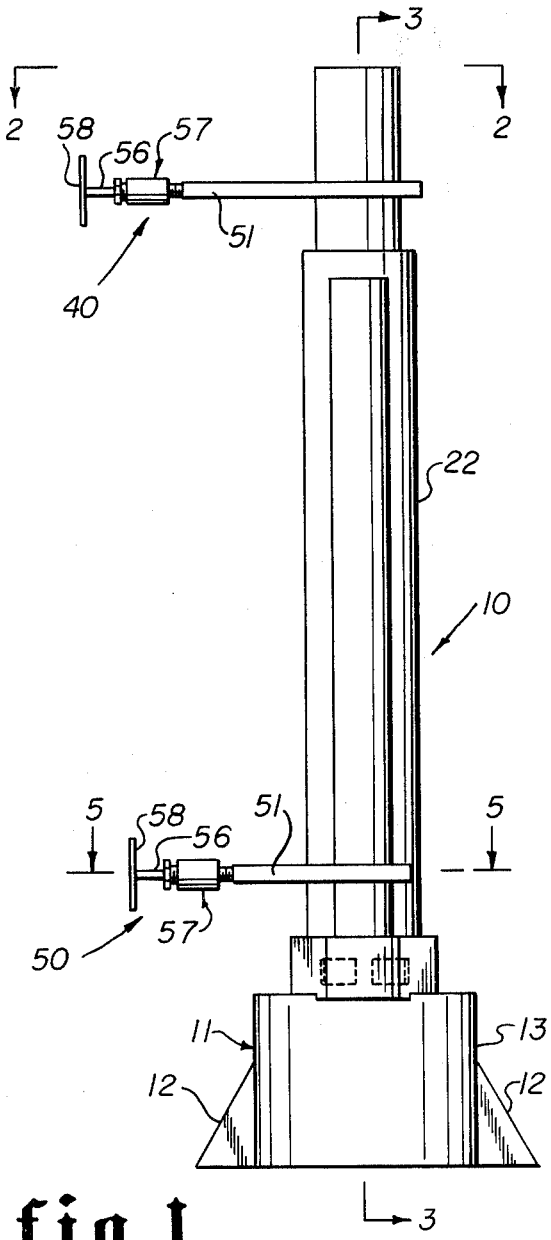
fig. 1
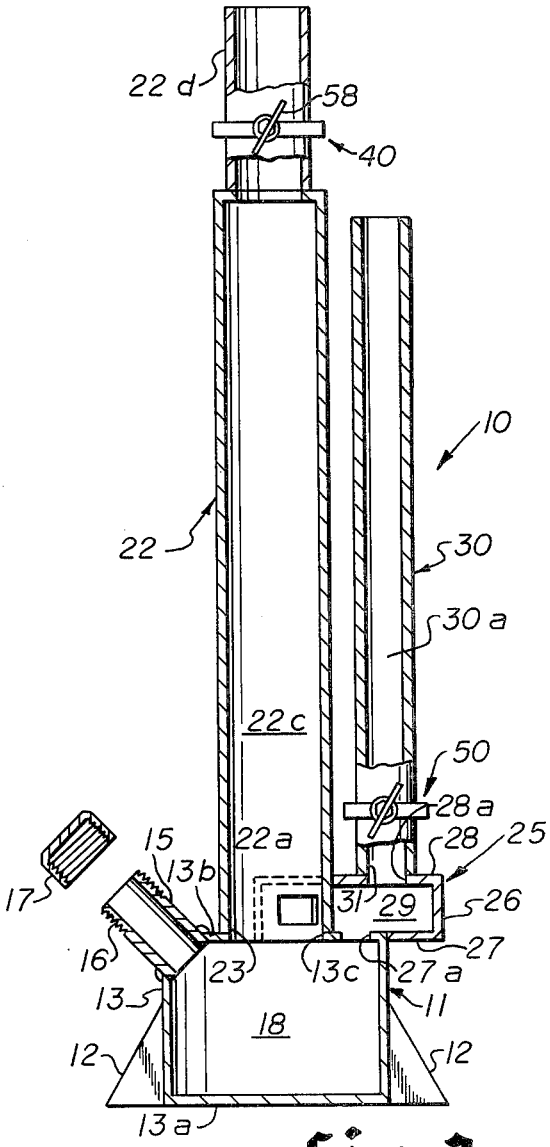
fig. 3

DRILLING RIG HEATER

SUMMARY OF THE INVENTION

Where heat is necessary for people working in exposed areas, or in buildings, it is desirable that the heat be provided in a manner to reduce the likelihood of fires. This is particularly true when a heater is employed in situations such as, by way of example, on the working floor area of an oil or gas drilling rig. Such heaters should not have an exposed flame while providing a maximum amount of heat to the surrounding atmosphere. Also, the heater should have adequate facilities so that it can be shut down rapidly in the event it should be accidentally knocked over or if other conditions require a quick shut down of the heater.

An object of the present invention is to provide a heater which may be positioned in an upright position and includes a first housing forming a fuel reservoir with a second housing on top of the first housing. A first elongated, hollow member or tubular member is secured to the top of the first housing and extends upwardly therefrom a substantial distance. A second elongated hollow or tubular member is mounted on top of the second housing and extends upwardly a substantial distance for communicating air to the second housing which in turn supplies air to the first housing and to the first hollow tubular member preferably adjacent its connection with the first housing. Valve means are provided in each the first and second hollow members or tubular members for controlling communication therethrough as desired.

An object of the present invention is to provide a heater which may be positioned in an upright position and includes a first housing forming a fuel reservoir with a second housing on top of the first housing. A first elongated, hollow member or tubular member is secured to the top of the first housing and extends upwardly therefrom a substantial distance. A second elongated hollow or tubular member is mounted on top of the second housing and extends upwardly a substantial distance for communicating air to the second housing which in turn supplies air to the first housing and to the first hollow tubular member preferably adjacent its connection with the first housing. Valve means are provided in each the first and second hollow members or tubular members for controlling communication therethrough as desired, the valve means in the first housing being mounted adjacent the upper end thereof in spaced longitudinal relationship to the first housing and the valve means in the second elongated tubular member being mounted adjacent the lower end thereof in close proximity to the second housing.

An object of the present invention is to provide a heater which may be positioned in an upright position and includes a first housing forming a fuel reservoir with a second housing on top of the first housing. A first elongated, hollow member or tubular member is secured to the top of the first housing and extends upwardly therefrom a substantial distance. A second elongated hollow or tubular member is mounted on top of the second housing and extends upwardly a substantial distance for communicating air to the second housing which in turn supplies air to the first housing and to the first hollow tubular member preferably adjacent its connection with the first housing. Valve means are provided in each the first and second hollow members or tubular members for controlling communication therethrough as desired, the valve means in the first housing being mounted adjacent the upper end thereof in spaced longitudinal relationship to the first housing and the valve means in the second elongated tubular member being mounted adjacent the lower end thereof in close proximity to the second housing and wherein the first housing is provided with an inlet for filling the reservoir with suitable fuel such as diesel.

Other objects and advantages of the present invention will become apparent from a consideration of the following drawings and description.

BRIEF DESCRIPTION OF THE DRAWINGS

FIG. 1 is a side elevational view illustrating the preferred embodiment of the present invention;

FIG. 2 is a top plan view on the line 2—2 of FIG. 1;

FIG. 3 is a sectional view on the line 3—3 of FIG. 2 to better illustrate the relationship of the components;

FIG. 4 is a sectional view on the line 4—4 of FIG. 2 showing the arrangement of the port means for communicating air from the second elongated tubular member to the first housing and the first elongated tubular member; and FIG. 5 is a sectional view on the line 5—5 of FIG. 1 illustrating the details of a form of valve means which may be employed with the present invention.

DESCRIPTION OF THE PREFERRED EMBODIMENT

Attention is first directed to FIG. 1 of the drawings wherein the heater of the present invention is referred to generally by the numeral 10. It is shown as including a first housing referred to generally at 11 which may be of any suitable configuration and is illustrated as being cylindrical in configuration. If desired, the housing 11 may be provided with suitable footings 12 secured to the outer periphery thereof at circumferentially spaced positions to aid in maintaining the housing 11 in the upright positions as illustrated in FIGS. 1 and 2 of the drawings. A suitable inlet as illustrated at 15 may be secured adjacent the upper end of the housing 11 which inlet is threaded as illustrated at 16 for receiving the cap 17 thereon. Diesel fuel, or other fuel as may be employed may be poured through the inlet 15 in the reservoir 18 formed by the housing 11.

The first housing 11 includes the circumferential side wall 13, the bottom **13*a* and the top 13*b* as shown. Secured to the top 13*b* and extending upwardly therefrom is a first hollow member or elongated tubular member 22. It will be noted that the longitudinal extent of the tubular member 22 in relation to the height of the housing 11 is substantial, and preferably the length of the first member 22 is at least four times the height of the first housing 18. The lower end 23 of the elongated tubular member 22 is open and communicates with the interior of the top of the reservoir 18 by means of the port 13*c* formed in the top 13*b* of the housing 11**.

A second housing referred to generally at 25 is also formed on the top wall **13*b* of the first housing 11 as shown in the drawings, and if necessary or desirable may partially encircle the first elongated member 22 as represented at 26 and 27 in FIG. 2. The second housing 25 includes the side 26, the bottom 27 and the top 28. The top 13*b* of the first housing 11 may be used to form part of bottom 27**, as shown in the drawings to form a closed housing, except as will be noted.

Mounted on the top 28 of the second housing 25 is a second elongated tubular member referred to at 30 which has its lower end 31 open to communicate with the interior 29 of the housing 25 through the port means 28*a* formed in the top 28 of the second housing 25. It will be noted that the longitudinal extent of the second tubular member 30 in relation to the height of the second housing 25 is substantial and preferably the longitudinal extent of the second tubular member 30 is as least three times the height of the first housing 11.

Port means 27*a* are provided in the top 13*b* of the first housing 11 for communicating the interior 29 of the second housing 25 with the reservoir 18 formed by the housing 11.

Also, port means 22*a* and 22*b* are formed in the elongated tubular member 22 adjacent the lower end 23 thereof to communicate the interior 29 of the second housing 25 with the interior of the first elongated tubular member 22.

Suitable valve means referred to generally at 40 are provided in the first elongated tubular member 22 and suitable valve means 50 are provided in the second elongated tubular member 30 as shown in the drawings. The valve 50 controls the communication of air from the surrounding atmosphere to the interior 29 of the housing 25 as well as to the interior of the reservoir 18 and to the interior 22*c* of the elongated tubular member 22.

Similarly, the valve 40 controls the discharge of exhaust gases from the heater through the reduced portion 22*d* formed on the upper end of the elongated tubular member 22.

The valve means 40 and 50 may take any suitable form and is preferably of a quick acting slide valve type such as that illustrated in FIG. 5. A laterally extending housing 51 intersects or extends transversely of the elongated tubular members 22 and 30 as shown in the drawings. Such housing 51 includes port means 52 for accommodating flow of air therethrough or for flow of exhaust gases from the stock or upper end 22*d* of the first elongated tubular member 22. The housing 51 includes the spaced longitudinally extending guide and support surfaces 53 and 54 which slidably receive the slide valve element 55 and support it for movement longitudinally of the housing 51 to open and close port 52.

A stem 56 is connected to the slide valve element 55 by any suitable means such as threads or the like as shown and extends through the packing gland 57 and is provided with a suitable knob 58 for manual operation.

When it is desired to close off communication through either the first elongated tubular member 22 or the second elongated tubular member 30, the element 58 may be engaged and the valve stem 56 moved or pushed inwardly relative to the housing 51 whereupon the slide valve element 50 closes all or a part of the opening 52 in the housing 51 as well as intersecting the elongated tubular member 22 or 30 in which the valve means is positioned for controlling communication therethrough.

In operation of the present invention the cap 17 may be removed after the heater has been positioned in an upright position and the reservoir 18 filled with diesel fuel. The valve means 40 and 50 is then opened by moving the valve elements 55 outwardly and positioning them as illustrated in FIG. 5 so that the interior of each of the first and second tubular members 22 and 30 is opened to the atmosphere. The diesel fuel may be lighted by any suitable means, and one manner of lighting is to ignite a large piece of paper and place it in the inlet 15 so that the diesel fuel in the reservoir 18 ignites. As soon as the diesel fuel becomes ignited the cap 17 may be replaced on the inlet 15 and air is supplied to such flame from the air box or housing 25 through the second elongated tubular member 30 from the port means 22*a* and 22*b* therein as well as from port means 27*a*. The flame may extend upwardly into the first elongated tubular member 22 so that the surface thereof becomes hot and radiates heat to the surrounding atmosphere. The exhaust gases are discharged through the reduced upper end 22*d* on the first elongated tubular member 22. The member 22 functions as a fire tube in that the fire may extend upwardly therein a substantial distance. The second elongated tubular member 30 functions as a breather tube to supply air to the burner 10 and enables the diesel fuel to remain ignited.

It will be noted that the diesel fuel and the fire are contained within the reservoir 18 and the fire tube formed by the first elongated tubular member 22 when the heater is in operation. Since the fire tube 22 is of substantial longitudinal extent, a surface area of substantial extent thereof may be heated to in turn radiate heat to the surrounding atmosphere.

If due to some emergency it is necessary to extinguish fire in the heater 10, this may be accomplished by closing the valve means 50 whereupon air supply to the fire is cut off and the fire becomes extinguished. Also, should the heater become knocked over, the valves 40 and 50 may be immediately actuated to put out the fire in the heater and to inhibit spillage of diesel fuel and fire through the elongated first tubular member 22.

The flame from the heater can be regulated by opening or closing the air valve 50 in the breather tube 30 that communicates with the air box 26 on top of the first housing 11.

The arrangement and length of the fire tube 22 and air tube 30 is such that flashing of the fire onto workers or the surrounding area is substantially inhibited, if not eliminated. Also, the slide gate valve arrangement is quickly and easily operated in the event an emergency or other circumstances require that such valves be closed to close off the fire tube 22, air tube 30 and reservoir 18. The heater of the present invention doesn't plug easily and thus a clean fuel is not required.

The foregoing disclosure and description of the invention are illustrative and explanatory thereof, and various changes in the size, shape, and materials as well as in the details of the illustrated construction may be made without departing from the spirit of the invention.

What is claimed is:

1. A heater including:

a. a substantially closed first housing forming a fuel and fire reservoir;

b. a first elongated hollow member mounted on top of said first housing with its lower end communicating with said first housing and extending upwardly therefrom;

c. a second housing mounted on top of said first housing, therebeing port means communicating said first and second housing and port means communicating said second housing and said first elongated member;

d. a second elongated hollow member mounted on said second housing and extending upwardly therefrom;

e. said second hollow member having an upper end for communicating air to the interior of said second hollow member, and said second hollow member having its lower end communicating with said second housing for communicating air to said second housing and to said first elongated hollow member;

f. valve means in said first elongated hollow member for controlling communication therethrough; and g. valve means in said second elongated hollow member for closing off the air supply to said first hollow member and the fuel and fire reservoir.

2. The invention of claim 1 including an inlet in said first housing for filling the reservoir with fuel.

3. The invention of claim 1 wherein said valve means in said second member is positioned adjacent said second housing and wherein said valve means in said first hollow member is longitudinally spaced from said first housing a substantial distance adjacent the top of said first hollow member.

4. The invention of claim 1 wherein the length of said first hollow member is at least about four times the height of said first housing.

5. The invention of claim 1 wherein the length of said second hollow member is at least about three times the height of said first housing.

6. The invention of claim 1 wherein said first hollow member includes a longitudinally extending portion adjacent its outer end of smaller size than the portion therebelow.

7. The invention of claim 1 wherein said port means which communicates said second housing and said first elongated member is adjacent the lower end of said first elongated member.

* * * * *